US011774907B2

(12) United States Patent
Kawasaki et al.

(10) Patent No.: US 11,774,907 B2
(45) Date of Patent: Oct. 3, 2023

(54) IMAGE FORMING APPARATUS CAPABLE OF SUPPRESSING DETERIORATION IN IMAGE QUALITY

(71) Applicant: KYOCERA Document Solutions Inc., Osaka (JP)

(72) Inventors: Kenichiro Kawasaki, Osaka (JP); Kazuhisa Hirahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/655,755

(22) Filed: Mar. 21, 2022

(65) Prior Publication Data

US 2022/0342364 A1 Oct. 27, 2022

(30) Foreign Application Priority Data

Apr. 27, 2021 (JP) ..... 2021-074683

(51) Int. Cl.
*G03G 21/18* (2006.01)
*G03G 21/16* (2006.01)

(52) U.S. Cl.
CPC ..... *G03G 21/1864* (2013.01); *G03G 21/1619* (2013.01); *G03G 21/1633* (2013.01); *G03G 2221/1654* (2013.01)

(58) Field of Classification Search
CPC ..... G03G 21/1864; G03G 21/1619; G03G 21/1633; G03G 2221/1654; G03G 15/04; G03G 15/04036; G03G 15/04045; G03G 2215/04
See application file for complete search history.

(56) References Cited

U.S. PATENT DOCUMENTS

2007/0253731 A1* 11/2007 Nakajima ..... G11B 7/22 399/126
2008/0231913 A1* 9/2008 Kurotsu ..... H04N 1/028 358/474

FOREIGN PATENT DOCUMENTS

JP 2006237752 A 9/2006

* cited by examiner

*Primary Examiner* — Sandra Brase
(74) *Attorney, Agent, or Firm* — Alleman Hall Creasman & Tuttle LLP

(57) ABSTRACT

An image forming apparatus includes a photoelectric conversion portion, a housing, a housing support portion, and a posture adjustment portion. The photoelectric conversion portion receives light reflected by a document sheet placed on a document sheet mounting surface and outputs an electric signal based on the light. The housing has a box shape with an open top and forms a housing space for housing the photoelectric conversion portion on a lower side of the document sheet mounting surface. The housing support portion supports a bottom portion of the housing. The posture adjustment portion includes an operation portion provided outside the housing, and adjusts a posture of the photoelectric conversion portion in accordance with an operation on the operation portion.

6 Claims, 7 Drawing Sheets

IMAGE FORMING APPARATUS CAPABLE OF SUPPRESSING DETERIORATION IN IMAGE QUALITY

INCORPORATION BY REFERENCE

This application is based upon and claims the benefit of priority from the corresponding Japanese Patent Application No. 2021-074683 filed on Apr. 27, 2021, the entire contents of which are incorporated herein by reference.

BACKGROUND

The present disclosure relates to an image forming apparatus.

An image forming apparatus including a reading unit for reading an image of a document sheet placed on a contact glass is known. The reading unit includes optical elements, such as a light source, a mirror, a lens, and a charge coupled device (CCD), and a box-shaped housing for housing the optical elements. A bottom portion of the housing is supported by a housing support portion provided on an upper portion of an apparatus main body of the image forming apparatus.

In the image forming apparatus, the posture of the housing supported by the housing support portion may be distorted due to variations in the shape of the housing support portion or the like. In this case, the image quality of image data output by the reading unit deteriorates. In contrast, an image forming apparatus provided with a mechanism for adjusting the support position of any corner portion of the bottom portion of the housing in an up-down direction in order to enable an adjustment of the posture of the housing is known.

SUMMARY

An image forming apparatus according to the present disclosure includes a photoelectric conversion portion, a housing, a housing support portion, and a posture adjustment portion. The photoelectric conversion portion receives light reflected by a document sheet placed on a document sheet mounting surface and outputs an electric signal based on the light. The housing has a box shape with an open top and forms a housing space for housing the photoelectric conversion portion on a lower side of the document sheet mounting surface. The housing support portion supports a bottom portion of the housing. The posture adjustment portion includes an operation portion provided outside the housing, and adjusts a posture of the photoelectric conversion portion in accordance with an operation on the operation portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiments of the present disclosure will be described below with reference to the accompanying drawings. It is noted that the following embodiments are examples of embodying the present disclosure and do not limit the technical scope of the present disclosure.

First Embodiment

First, a configuration of an image forming apparatus 100 according to a first embodiment of the present disclosure will be described with reference to FIG. 1. It is noted that, in FIG. 1, an optical path R1 from a light emitting portion 21A to a CCD 24 in an image reading portion 2 is indicated by a broken line with an arrow.

It is noted that, for convenience of description, the vertical direction in an installation state (the state shown in FIG. 1) in which the image forming apparatus 100 can be used is defined as an up-down direction D1. In addition, a front-rear direction D2 is defined assuming that the surface of the image forming apparatus 100 shown in FIG. 1 on the near side on the figure is the front side (front surface). In addition, a left-right direction D3 is defined with reference to the front side of the image forming apparatus 100 in the installation state.

The image forming apparatus 100 is a multifunction peripheral having a plurality of functions such as a facsimile function and a copy function in addition to a scan function for reading an image of a document sheet and a print function for forming an image based on image data. The present disclosure may be applied to an image forming apparatus with the scan function, such as a facsimile apparatus or a copier.

Figure 1:
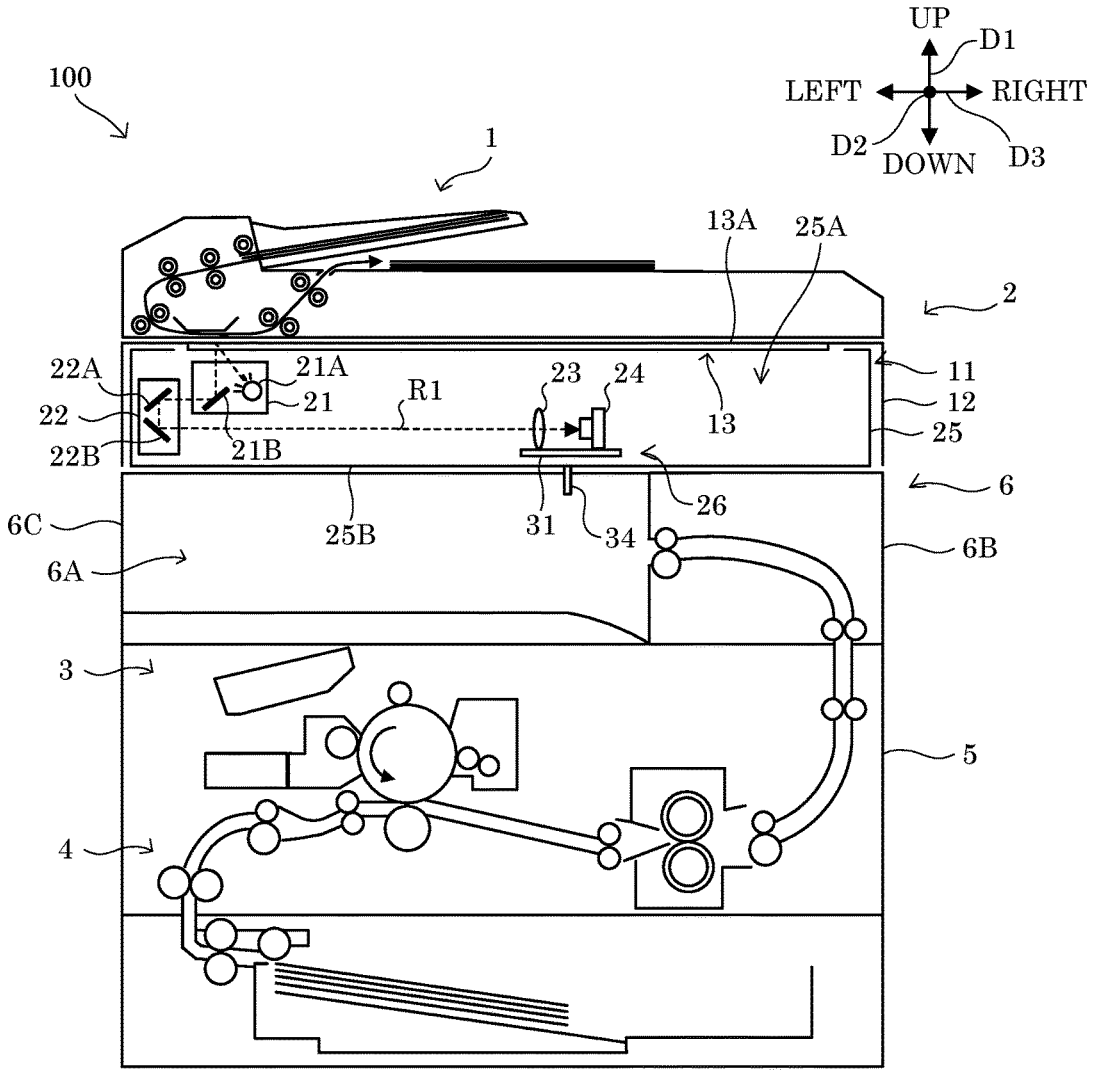
FIG. 1 is a cross-sectional view showing a configuration of an image forming apparatus according to a first embodiment of the present disclosure.

As shown in FIG. 1, the image forming apparatus 100 includes an auto document feeder (ADF) 1, an image reading portion 2, an image forming portion 3, a sheet feed portion 4, an apparatus main body 5, and a housing support portion 6.

The ADF 1 conveys a document sheet whose image is read by the image reading portion 2. The ADF 1 includes a document sheet loading portion, a plurality of conveying rollers, a document sheet holder, and a sheet discharge portion. In addition, the ADF 1 is supported in such a way as to open and close a document sheet mounting surface 13A (see FIG. 1), and also serves as a document sheet cover for the document sheet placed on the document sheet mounting surface 13A.

The image reading portion 2 implements the scan function. Specifically, the image reading portion 2 reads an image from a document sheet conveyed by the ADF 1 and outputs image data including the read image. In addition, the image reading portion 2 reads an image from a document sheet placed on the document sheet mounting surface 13A (see FIG. 1) and outputs image data including the read image.

The image forming portion 3 implements the print function. Specifically, the image forming portion 3 forms an image using electrophotography. The image forming portion 3 includes a photoconductor drum, a charging roller, a laser scanning unit, a developing device, a transfer roller, a cleaning device, and a fixing device. The image forming portion 3 forms an image on the basis of image data output by the image reading portion 2.

The sheet feed portion 4 supplies a sheet to the image forming portion 3. The sheet feed portion 4 includes a sheet feed cassette and a plurality of conveying rollers. The image forming portion 3 forms an image on a sheet supplied from the sheet feed portion 4. The sheet on which an image has been formed by the image forming portion 3 is discharged to a sheet discharge space 6A (see FIG. 1).

The apparatus main body 5 is a housing for housing the image forming portion 3 and the sheet feed portion 4. As shown in FIG. 1, the sheet feed portion 4 is provided in a lower portion of the apparatus main body 5. In addition, the image forming portion 3 is provided on the upper side of the sheet feed portion 4 in the apparatus main body 5.

In addition, the apparatus main body 5 supports the ADF 1 and the image reading portion 2. As shown in FIG. 1, the sheet reading portion 2 is provided on the upper side of the apparatus main body 5. In addition, the ADF 1 is provided on the upper side of the image reading portion 2.

The housing support portion 6 supports a bottom portion 25B (see FIG. 1) of the housing 25 of the image reading portion 2. In addition, the housing support portion 6 forms the sheet discharge space 6A (see FIG. 1) on the lower side of the housing 25 so as to be opened in at least one direction along the horizontal direction.

As shown in FIG. 1, the housing support portion 6 is provided on an upper portion of the apparatus main body 5. The sheet discharge space 6A is a space where the front side and left side of the image forming apparatus 100 are opened. A right side support portion 6B (see FIG. 1) standing upward is provided on the right side of the sheet discharge space 6A. A rear side support portion 6C (see FIG. 1) standing upward is provided on the rear side of the sheet discharge space 6A. The housing 25 of the image reading portion 2 is supported by the upper surface of the right side support portion 6B and the upper surface of the rear side support portion 6C.

Next, the image reading portion 2 will be described with reference to FIG. 1 and FIG. 2.

As shown in FIG. 1, the image reading portion 2 includes a reading unit 11, an exterior portion 12, and a contact glass 13.

The exterior portion 12 is a resin cover covering the side surface of the reading unit 11. A rectangular opening portion that opens upward is provided in an upper portion of the exterior portion 12.

The contact glass 13 is attached to the opening portion of the exterior portion 12 from the lower side of the opening portion. The opening portion is closed by the contact glass 13. A reading target document sheet is placed on the contact glass 13. Namely, the upper surface of the contact glass 13 functions as the document sheet mounting surface 13A on which a document sheet is placed.

The reading unit 11 is provided on the lower side of the contact glass 13. As shown in FIG. 1, the reading unit 11 includes a first carriage 21, a second carriage 22, an optical lens 23, a charge coupled device (CCD) 24, a housing 25, and a posture adjustment portion 26.

The housing 25 forms, on the lower side of the document sheet mounting surface 13A, a housing space 25A for housing the components of the reading unit 11 including the CCD 24. The housing 25 is formed in a box shape with an open top. Specifically, as shown in FIG. 2, the housing 25 includes a rectangular bottom portion 25B elongated in the left-right direction D3, and four side wall portions 25C standing along the respective sides of the bottom portion 25B. The housing space 25A is formed by the bottom portion 25B and the four side wall portions 25C. The housing 25 is formed of a sheet metal member.

The first carriage 21 is provided so as to be movable in the left-right direction D3 inside the housing 25. The first carriage 21 is elongated in the front-rear direction D2. As shown in FIG. 1, the first carriage 21 includes a light emitting portion 21A and a first mirror 21B. The light emitting portion 21A and the first mirror 21B are provided so as to be movable together with the first carriage 21.

The light emitting portion 21A emits light from the lower side of the document sheet mounting surface 13A toward the document sheet mounting surface 13A. The light emitting portion 21A includes a plurality of light emitting elements arranged along the front-rear direction D2. The first mirror carriage 21B is elongated in the front-rear direction D2. The first mirror 21B reflects light emitted from the light emitting portion 21A and reflected by a document sheet placed on the document sheet mounting surface 13A toward a second mirror 22A of the second carriage 22.

The first carriage 21 moves in the left-right direction D3 under a driving force supplied from a motor (not shown). Thus, the irradiation position of light emitted from the light emitting portion 21A on the document sheet placed on the document sheet mounting surface 13A moves in the left-right direction D3.

The second carriage 22 is provided so as to be movable in the left-right direction D3 inside the housing 25. The second carriage 22 is elongated in the front-rear direction D2. As shown in FIG. 1, the second carriage 22 includes a second mirror 22A and a third mirror 22B. The second mirror 22A and the third mirror 22B are provided so as to be movable together with the second carriage 22.

The second mirror 22A reflects light reflected by the first mirror 21B toward the third mirror 22B. The third mirror 22B reflects light reflected by the second mirror 22A toward the optical lens 23.

The second carriage 22 is provided on the left side of the first carriage 21 inside the housing 25. The second carriage 22 is provided so as to be movable in the same direction as the first carriage 21 in conjunction with the first carriage 21. In addition, the second carriage 22 is provided so as to be movable at half the moving speed of the first carriage 21.

The optical lens 23 collects light reflected by the third mirror 22B and makes the light enter the CCD 24.

The CCD 24 receives light reflected by the document sheet placed on the document sheet mounting surface 13A and outputs an electric signal based on the light. The CCD 24 is an image sensor including a plurality of photoelectric conversion elements arranged along the front-rear direction D2. The CCD 24 is an example of the photoelectric conversion portion of the present disclosure.

In the image reading portion 2, light emitted from the light emitting portion 21A and reflected by the reading target document sheet enters the CCD 24 via the first mirror 21B, the second mirror 22A, the third mirror 22B, and the optical lens 23. Thus, an analog electric signal corresponding to the image of the reading target document sheet is output from the CCD 24. The analog electrical signal output from the CCD 24 is input to an analog front-end circuit (not shown). In the analog front-end circuit, the input analog electric signal is converted into a digital electric signal (image data) and output. The image data output from the analog front-end circuit is input to a control portion (not shown).

Meanwhile, in the image forming apparatus 100, the posture of the housing 25 supported by the housing support portion 6 may be distorted due to variations in the shape of the housing support portion 6 or the like. In this case, the image quality of image data output by the reading unit 11 deteriorates. With regard to this problem, there is known an image forming apparatus provided with a mechanism for adjusting the support position of any corner portion of the bottom portion 25B of the housing 25 in the up-down direction D1 in order to enable an adjustment of the posture of the housing 25.

Here, the deterioration in image quality of image data output by the reading unit 11 due to the distortion of the posture of the housing 25 can be suppressed also by adjusting the posture of the CCD 24. Specifically, a mechanism for adjusting the posture of the CCD 24 may be provided inside the housing 25.

However, when an operation portion used for the posture adjustment of the CCD 24 is provided inside the housing 25, it is necessary to remove the contact glass 13 and open the upper portion of the housing 25 in order to operate the operation portion. In this case, dust may enter the housing 25 and adhere to optical elements, such as the light emitting portion 21A, the first mirror 21B, the second mirror 22A, the third mirror 22B, the optical lens 23, and the CCD 24, which are provided on the optical path R1, so that the image quality of image data output by the reading unit 11 may deteriorate.

In contrast, the image forming apparatus 100 according to the first embodiment of the present disclosure can suppress the deterioration in image quality of image data output by the reading unit 11 without adjusting the posture of the housing 25 and opening the upper portion of the housing 25, as will be described below.

Figure 4:
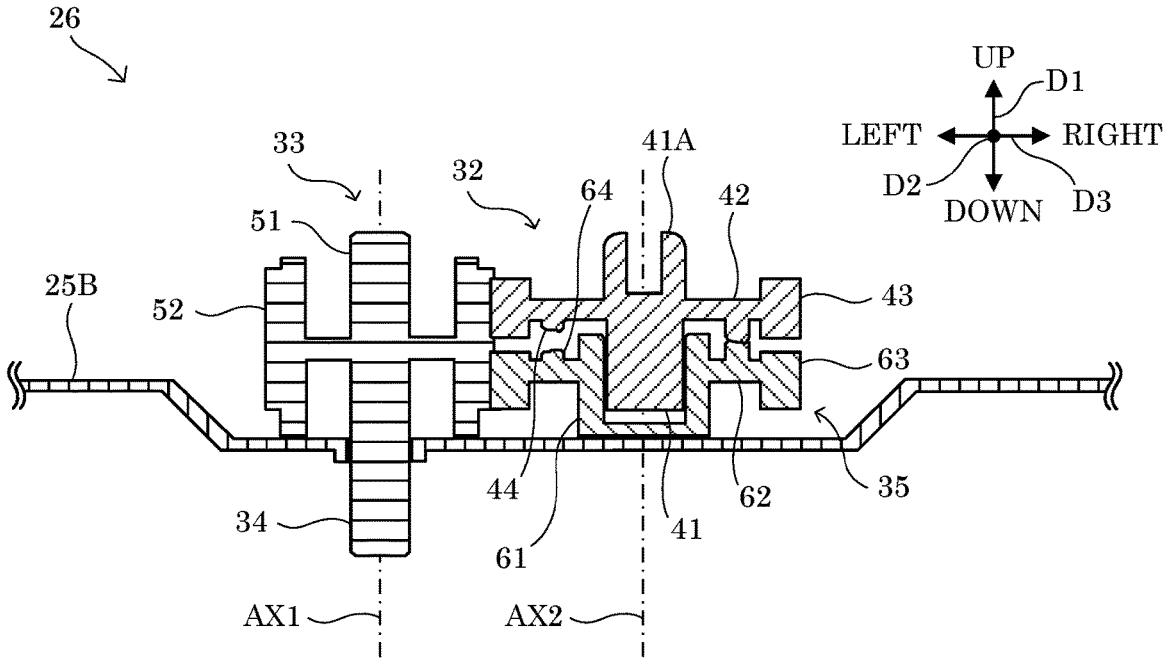
FIG. 4 is a cross-sectional view showing a configuration of the posture adjustment portion of the image forming apparatus according to the first embodiment of the present disclosure.
Figure 5:
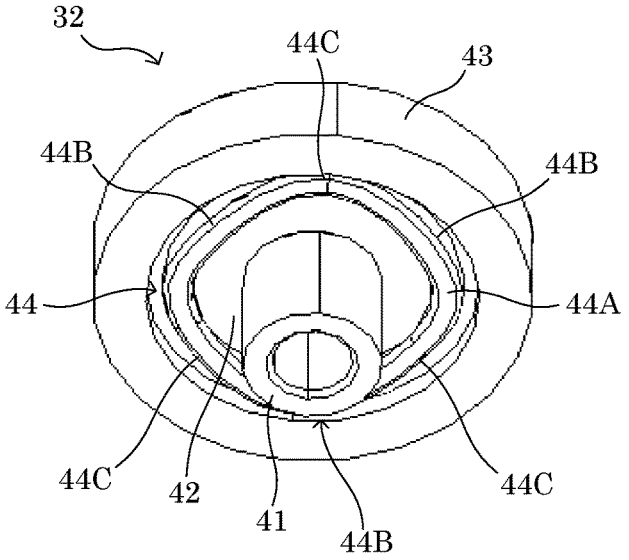
FIG. 5 is a perspective view showing a configuration of a second gear of the image forming apparatus according to the first embodiment of the present disclosure.
Figure 6:
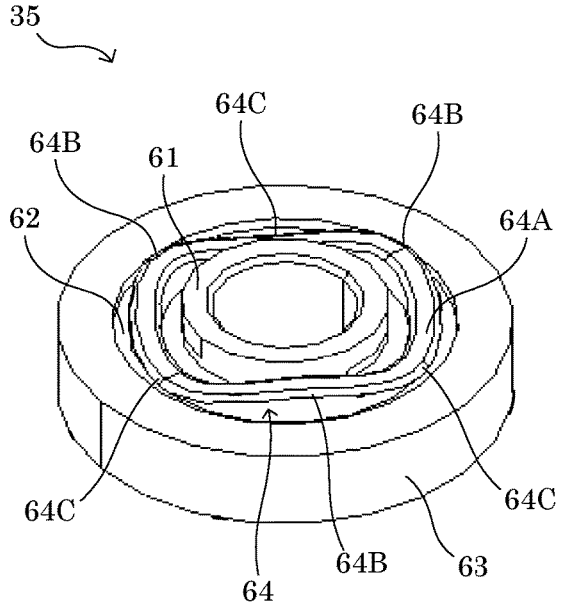
FIG. 6 is a perspective view showing a configuration of a third gear of the image forming apparatus according to the first embodiment of the present disclosure.

Next, the posture adjustment portion 26 will be described with reference to FIG. 1 to FIG. 6. Here, FIG. 3 shows a state in which a support member 31 is removed from the housing 25 shown in FIG. 2. In addition, FIG. 4 is a cross-sectional view of a second gear 32, a first gear 33, and a third gear 35 shown in FIG. 3 taken along a plane orthogonal to the front-rear direction D2. In addition, FIG. 5 is a perspective view of the second gear 32 viewed from below. In addition, FIG. 6 is a perspective view of the third gear 35 viewed from above. It is noted that, in FIG. 4, a first axis AX1, which is a rotation axis of the first gear 33, and a second axis AX2, which is a rotation axis common to the second gear 32 and the third gear 35, are indicated by dash-dot-dash lines.

The posture adjustment portion 26 has an operation portion 34 (see FIG. 1) provided outside the housing 25, and adjusts the posture of the CCD 24 in accordance with an operation on the operation portion 34.

As shown in FIG. 1, the operation portion 34 is provided on the lower side of the bottom portion 25B of the housing 25. As shown in FIG. 1 and FIG. 4, the operation portion 34 is formed in a shaft shape protruding downward through the bottom portion 25B of the housing 25. The operation portion 34 is rotatable about a first axis AX1 (see FIG. 4) that extends along the protruding direction. The posture adjustment portion 26 adjusts the posture of the CCD 24 in accordance with the rotation of the operation portion 34.

Figure 2:
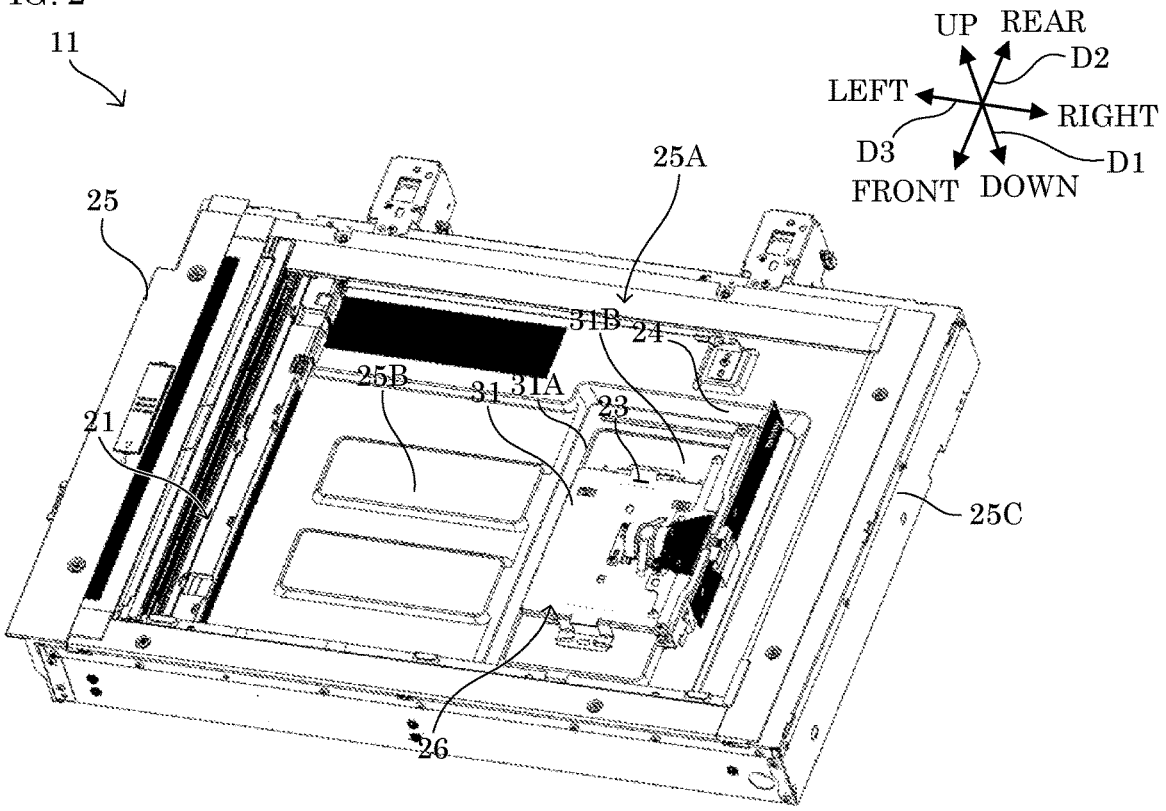
FIG. 2 is a perspective view showing a configuration of a reading unit of the image forming apparatus according to the first embodiment of the present disclosure.
Figure 3:
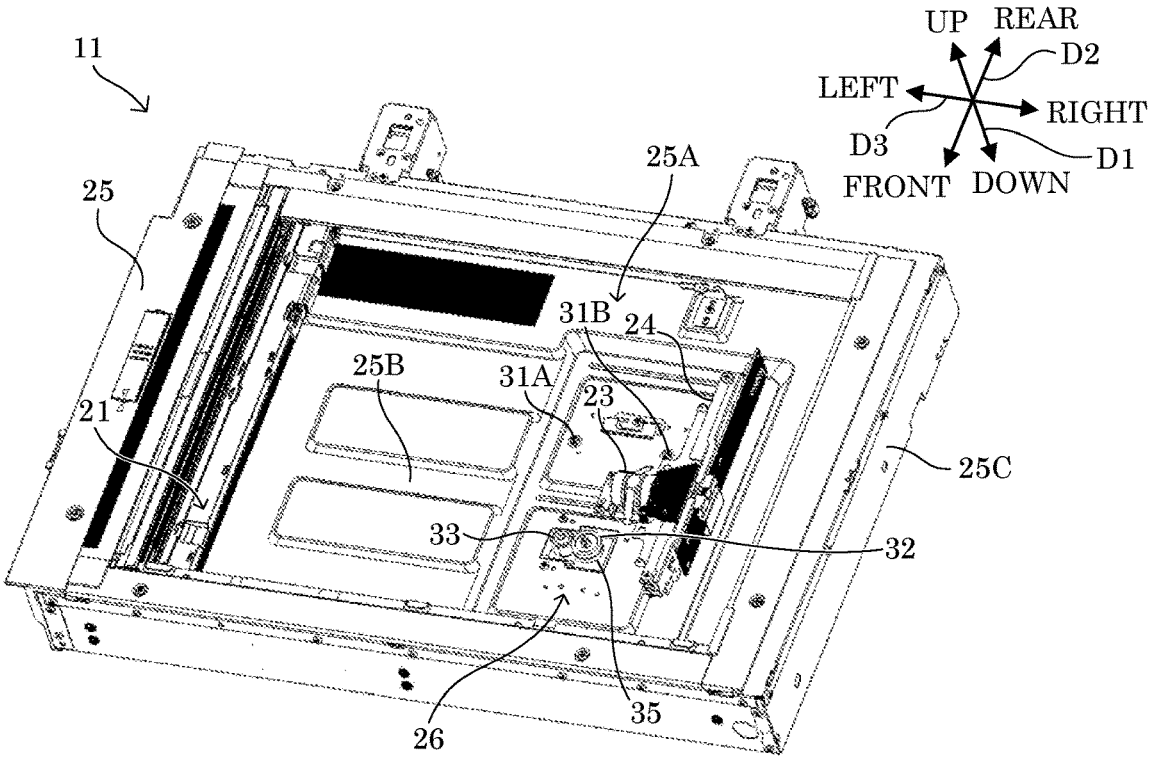
FIG. 3 is a perspective view showing a configuration of a posture adjustment portion of the image forming apparatus according to the first embodiment of the present disclosure.

As shown in FIG. 2 and FIG. 3, the posture adjustment portion 26 includes a support member 31, a second gear 32, a first gear 33, and a third gear 35 in addition to the operation portion 34.

The support member 31 supports the CCD 24 on the lower side of the CCD 24. As shown in FIG. 2, the support member 31 is a flat member formed in a rectangular shape. The optical lens 23 and a substrate including the CCD 24 are attached to the upper surface of the support member 31. Namely, the support member 31 supports the optical lens 23 and the CCD 24. It is noted that the support member 31 may be a member having any shape. In addition, the support member 31 may not support the optical lens 23.

As shown in FIG. 2 and FIG. 3, the support member 31 is supported from below by a support screw 31A (see FIG. 2 and FIG. 3), a support screw 31B (see FIG. 2 and FIG. 3), and a second gear 32. The support screw 31A supports a left rear end of the bottom surface of the support member 31. The support screw 31B supports a right rear end of the bottom surface of the support member 31. The second gear 32 supports a front end of the bottom surface of the support member 31.

The second gear 32 is provided on the lower side of the support member 31 so as to be rotatable about the second axis AX2 (see FIG. 4) that is parallel to the first axis AX1. The second gear 32 supports the support member 31. The second gear 32 is displaced in the up-down direction D1 in accordance with the rotation. The second gear 32 is a spur gear.

As shown in FIG. 4 and FIG. 5, the second gear 32 includes a shaft hole portion 41, a disk-shaped portion 42, a tooth portion 43, and a first cam portion 44. The shaft hole portion 41 is formed in a cylindrical shape, and a rotary shaft standing on the bottom portion 25B of the housing 25 is inserted into the shaft hole portion 41. An upper end 41A of the shaft hole portion 41 is in contact with the bottom surface of the support member 31 and supports the support member 31. The disk-shaped portion 42 is formed in a disk shape centered on the second axis AX2. The tooth portion 43 is provided on the outer peripheral portion of the disk-shaped portion 42. The tooth portion 43 includes a plurality of teeth arranged along the outer periphery of the disk-shaped portion 42.

The first cam portion 44 is formed on a lower side surface of the disk-shaped portion 42 orthogonal to the up-down direction D1. In other words, the first cam portion 44 is formed on a portion facing the third gear 35. As shown in FIG. 5, the first cam portion 44 is formed outside the shaft hole portion 41 and inside the tooth portion 43. The first cam portion 44 forms a first cam surface 44A that undulates up and down along the circumferential direction of the second axis AX2. The first cam surface 44A is a smooth inclined surface continuous along the circumferential direction of the second axis AX2. As shown in FIG. 5, the first cam portion 44 includes three peak portions 44B arranged at equal intervals along the circumferential direction of the second axis AX2, and three valley portions 44C arranged at equal intervals along the circumferential direction of the second axis AX2 and each arranged in the middle of two peak portions 44B adjacent to each other in the circumferential direction. The peak portions 44B protrude downward from the tooth portion 43. It is noted that the number of the peak portions 44B and the number of valley portions 44C need not be limited to three.

The first gear 33 is provided so as to be rotatable together with the operation portion 34. Namely, the first gear 33 is provided so as to be rotatable about the first axis AX1. The first gear 33 meshes with the second gear 32 and the third gear 35. The first gear 33 is a spur gear.

As shown in FIG. 4, the first gear 33 includes a shaft portion 51 and a tooth portion 52. The shaft portion 51 is formed in a columnar shape. The shaft portion 51 protrudes downward through the bottom portion 25B of the housing 25. A portion of the shaft portion 51 which protrudes from the bottom portion 25B is the operation portion 34. The tooth portion 52 is provided along the circumferential direction of the shaft portion 51. The tooth portion 52 is provided so as to be rotatable together with the shaft portion 51. The tooth portion 52 includes a plurality of teeth arranged along the circumferential direction of the shaft portion 51.

For example, the tooth portion 52 has 0.4 times the number of teeth of the second gear 32. In this case, when the first gear 33 rotates 180 degrees, the second gear 32 rotates 72 degrees. Namely, when the first gear 33 makes a half rotation, the second gear 32 makes a one-fifth rotation.

The first gear 33 is rotated by a rotational driving force input through the operation portion 34 by a hand of an operator who operates the operation portion 34. Thus, the second gear 32 and the third gear 35, which mesh with the first gear 33, rotate.

The third gear 35 is provided on the lower side of the second gear 32 so as to be rotatable about the second axis AX2. The third gear 35 meshes with the first gear 33. The third gear 35 is a spur gear.

As shown in FIG. 4 and FIG. 6, the third gear 35 includes a shaft hole portion 61, a disk-shaped portion 62, a tooth portion 63, and a second cam portion 64. The shaft hole portion 61 is formed in a cylindrical shape, and the shaft hole portion 41 of the second gear 32 is inserted into the shaft hole portion 61. The disk-shaped portion 62 is formed in a disk shape centered on the second axis AX2. The tooth portion 63 is provided on the outer peripheral portion of the disk-shaped portion 62. The tooth portion 63 includes a plurality of teeth arranged along the outer periphery of the disk-shaped portion 62.

The second cam portion 64 is formed on an upper side surface of the disk-shaped portion 62 orthogonal to the up-down direction D1. In other words, the second cam portion 64 is formed on a portion facing the second gear 32. As shown in FIG. 6, the second cam portion 64 is formed outside the shaft hole portion 61 and inside the tooth portion 63. The second cam portion 64 forms a second cam surface 64A that undulates up and down along the circumferential direction of the second axis AX2. The second cam surface 64A is a smooth inclined surface continuous along the circumferential direction of the second axis AX2. As shown in FIG. 6, the second cam portion 64 includes three peak portions 64B arranged at equal intervals along the circumferential direction of the second axis AX2, and three valley portions 64C arranged at equal intervals along the circumferential direction of the second axis AX2 and each arranged in the middle of two peak portions 64B adjacent to each other in the circumferential direction. The peak portions 64B protrude upward from the tooth portion 63. It is noted that the number of the peak portions 64B and the number of valley portions 64C need not be limited to three.

The second cam surface 64A is formed in a shape corresponding to the first cam surface 44A. Specifically, the second cam surface 64A is formed so as to be able to be in close contact with the first cam surface 44A. In other words, the second cam surface 64A is formed so as to enable the valley portions 64C to come into contact with the peak portions 44B of the first cam surface 44A at the same time as the peak portions 64B come into contact with the valley portions 44C of the first cam surface 44A. It is noted that the first cam surface 44A may not be formed in a shape corresponding to the second cam surface 64A. In addition, the second gear 32 may include, instead of the first cam portion 44, one or more protruding portions protruding from the lower side surface of the disk-shaped portion 42 to the same positions as the peak portions 44B.

The third gear 35 supports the second gear 32 from the lower side of the second gear 32. Specifically, the second cam surface 64A of the third gear 35 is in contact with the peak portions 44B of the second gear 32 and supports the second gear 32.

The tooth portion 63 has a different number of teeth from the second gear 32. For example, the number of teeth of the tooth portion 63 is one less than the number of teeth of the second gear 32. Thus, the third gear 35 rotates at a rotational speed slightly higher than that of the second gear 32 in accordance with the rotation of the first gear 33. Therefore, the support positions of the second gear 32 on the second cam surface 64A, that is, the contact positions with the peak portions 44B of the first cam portion 44, move at a rotational speed corresponding to the speed difference between the second gear 32 and the third gear 35. Thus, the second gear 32 is displaced in the up-down direction D1 by the second cam surface 64A. Accordingly, the posture of the support member 31 supported by the second gear 32 changes, and the postures of the optical lens 23 and the CCD 24 supported by the support member 31 also change. The second cam surface 64A is an example of the cam surface of the present disclosure. The peak portions 44B of the first cam portion 44 are an example of the pressed portion of the present disclosure. It is noted that, the number of teeth of the tooth portion 63 may be one more than the number of teeth of the second gear 32. In addition, the difference in the number of teeth between the second gear 32 and the third gear 35 may be arbitrarily determined within a range that does not inhibit the rotation corresponding to the rotation of the first gear 33.

As described above, in the image forming apparatus 100, the operation portion 34 is provided outside the housing 25. Thus, it is possible to suppress deterioration in image quality of image data output by the reading unit 11 without opening the upper portion of the housing 25 in comparison with a configuration in which the operation portion 34 is provided inside the housing 25. In addition, the deterioration in image quality of image data output by the reading unit 11 can be suppressed without adjusting the posture of the housing 25.

In addition, in the image forming apparatus 100, the operation portion 34 is provided on the lower side of the bottom portion 25B of the housing 25. Therefore, the size of the image forming apparatus 100 in the horizontal direction can be prevented from increasing in comparison with a configuration in which the operation portion 34 is provided outside a side wall portion 25C of the housing 25.

In addition, in the image forming apparatus 100, the operation portion 34 is formed in a shaft shape that rotates about the first axis AX1, and the posture of the CCD 24 is adjusted in accordance with the rotation of the operation portion 34. Thus, the size of the operation portion 34 can be reduced in comparison with a configuration in which the operation portion 34 is provided so as to be movable along the horizontal direction and the posture of the CCD 24 is adjusted in accordance with the movement along the horizontal direction.

In addition, in the image forming apparatus 100, a second gear 32 that meshes with a first gear 33 that rotates together with the operation portion 34 is provided, and the posture of the CCD 24 is adjusted by the second gear 32 being displaced in the up-down direction D1 in accordance with the rotation of the operation portion 34. Thus, the operability of the operation portion 34 can be prevented from changing because the amount of protrusion from the bottom portion 25B of the operation portion 34 is unchanged, in comparison with a configuration in which the operation portion 34 is displaced in the up-down direction D1 in accordance with the rotation of the operation portion 34 and the posture of the CCD 24 is thereby adjusted.

In addition, in the image forming apparatus 100, a third gear 35 that rotates at a speed different from that of the second gear 32 is provided on the lower side of the second gear 32, and the second gear 32 is displaced in the up-down direction D1 by the second cam portion 64 of the third gear 35. Thus, the displacement amount of the second gear 32, that is, the adjustment amount of the posture of the CCD 24, when the operation portion 34 is operated by a predetermined amount, can be reduced in comparison with a configuration in which the third gear 35 is not provided and the second gear 32 is displaced in the up-down direction D1 by a cam surface formed on the bottom portion 25B of the housing 25. Namely, it is possible to make a finer adjustment.

It is noted that the posture adjustment portion 26 may not include the third gear 35. In addition, the posture adjustment portion 26 may not include both the third gear 35 and the second gear 32. In addition, the posture adjustment portion 26 may include an operation portion provided so as to be movable along the horizontal direction, instead of the operation portion 34. For example, it is conceivable to provide a bar-shaped operation portion extending in the up-down direction D1 so as to be movable along the horizontal direction and provide an inclined surface inclined in the up-down direction along the moving direction of the operation portion, at a portion of the bottom surface of the support member 31 that comes in contact with an upper end of the operation portion.

Second Embodiment

Next, a configuration of an image forming apparatus 100 according to a second embodiment of the present disclosure will be described with reference to FIG. 7.

Figure 7:
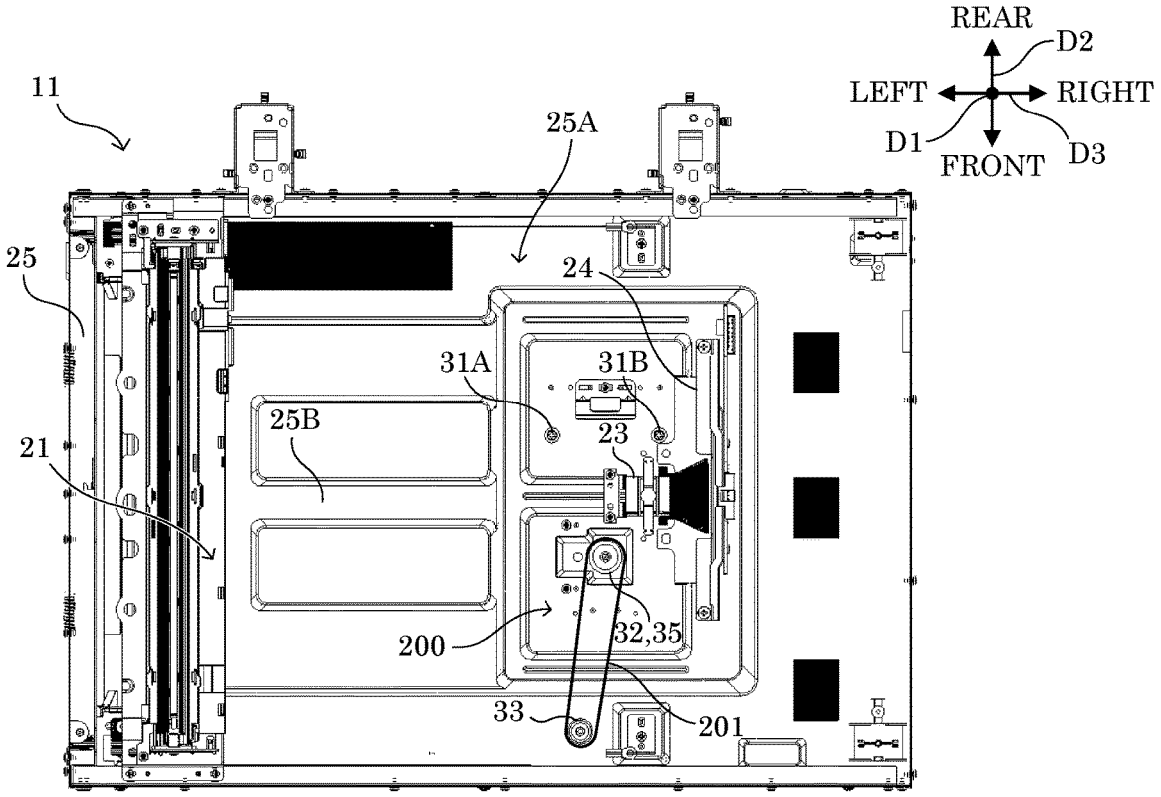
FIG. 7 is a plan view showing a configuration of a posture adjustment portion of an image forming apparatus according to a second embodiment of the present disclosure.

The image forming apparatus 100 according to the second embodiment includes a posture adjustment portion 200 shown in FIG. 7 instead of the posture adjustment portion 26.

The posture adjustment portion 200 includes a support member 31, a second gear 32, a first gear 33, an operation portion 34, a third gear 35, and a belt member 201. The configurations of the support member 31, the second gear 32, and the third gear 35 are the same as those in the posture adjustment portion 26.

In the posture adjustment portion 200, the first gear 33 is spaced apart from the second gear 32 in a direction orthogonal to the second axis AX2, as shown in FIG. 7. Therefore, the operation portion 34 formed integrally with the first gear 33 is also spaced apart from the second gear 32 in the direction orthogonal to the second axis AX2. It is noted that the shapes of the first gear 33 and the operation portion 34 are the same as those in the posture adjustment portion 26.

The belt member 201 is wound around the first gear 33, the second gear 32, and the third gear 35, and transmits, to the second gear 32 and the third gear 35, a rotational driving force input to the first gear 33. Specifically, the belt member 201 has, on its inner peripheral surface, a tooth portion that meshes with the first gear 33, the second gear 32, and the third gear 35.

Thus, the posture of the CCD 24 can be adjusted in the same manner as done in the posture adjustment portion 26. In addition, in the posture adjustment portion 200, the first gear 33 and the operation portion 34 can be disposed at any positions on the bottom surface 25B of the housing 25. Therefore, the operability of the operation portion 34 can be improved in comparison with the posture adjustment portion 26.

Third Embodiment

Next, a configuration of an image forming apparatus 100 according to a third embodiment of the present disclosure will be described with reference to FIG. 8 and FIG. 9. It is noted that, in FIG. 9, a third axis AX3, which is a rotation axis of a seventh gear 305, is indicated by a filled circle. In addition, in FIG. 9, a fourth axis AX4, which is a rotation axis of a fourth gear 302, and a fifth axis AX5, which is a rotation axis common to a fifth gear 303 and a sixth gear 304, are indicated by dash-dot-dash lines.

Figure 8:
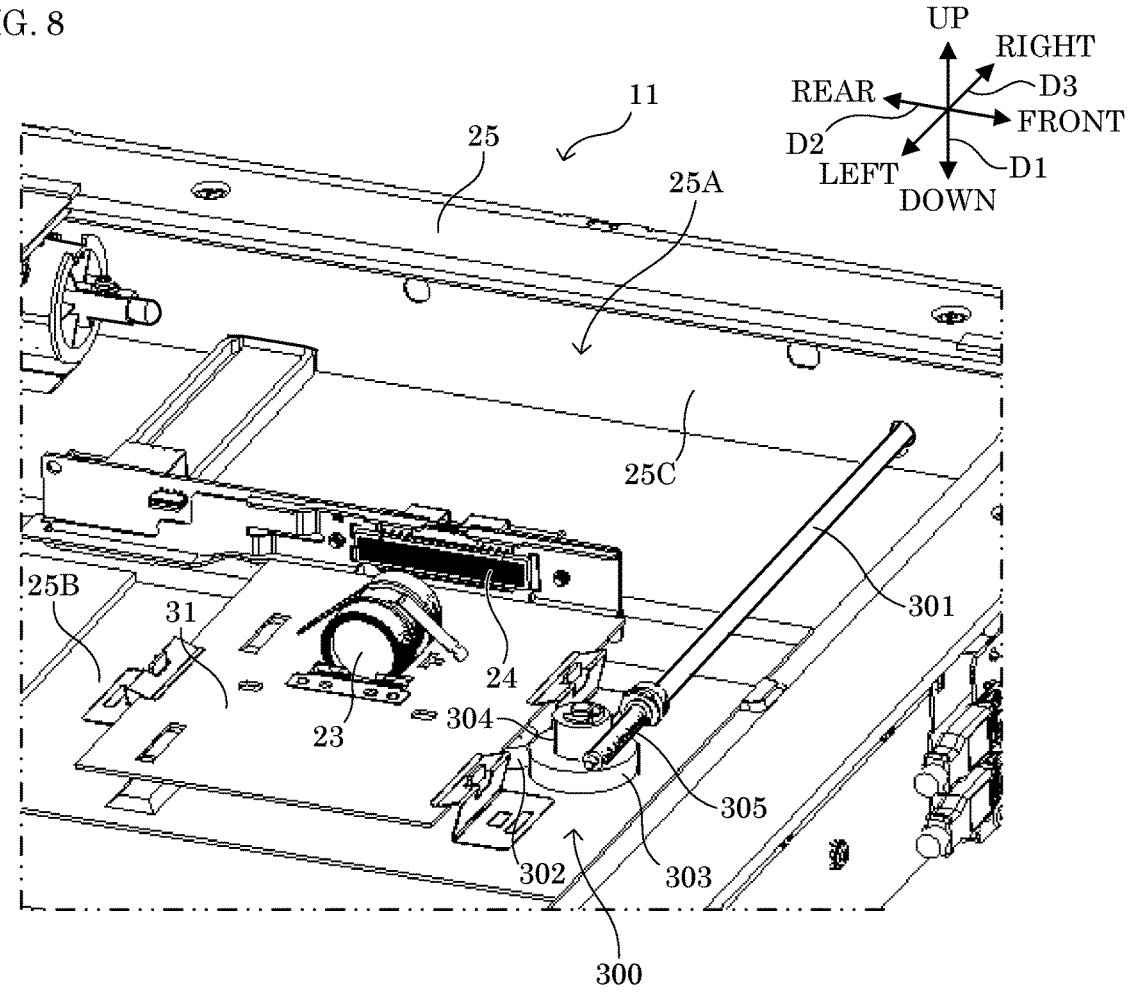
FIG. 8 is a perspective view showing a configuration of a posture adjustment portion of an image forming apparatus according to a third embodiment of the present disclosure.
Figure 9:
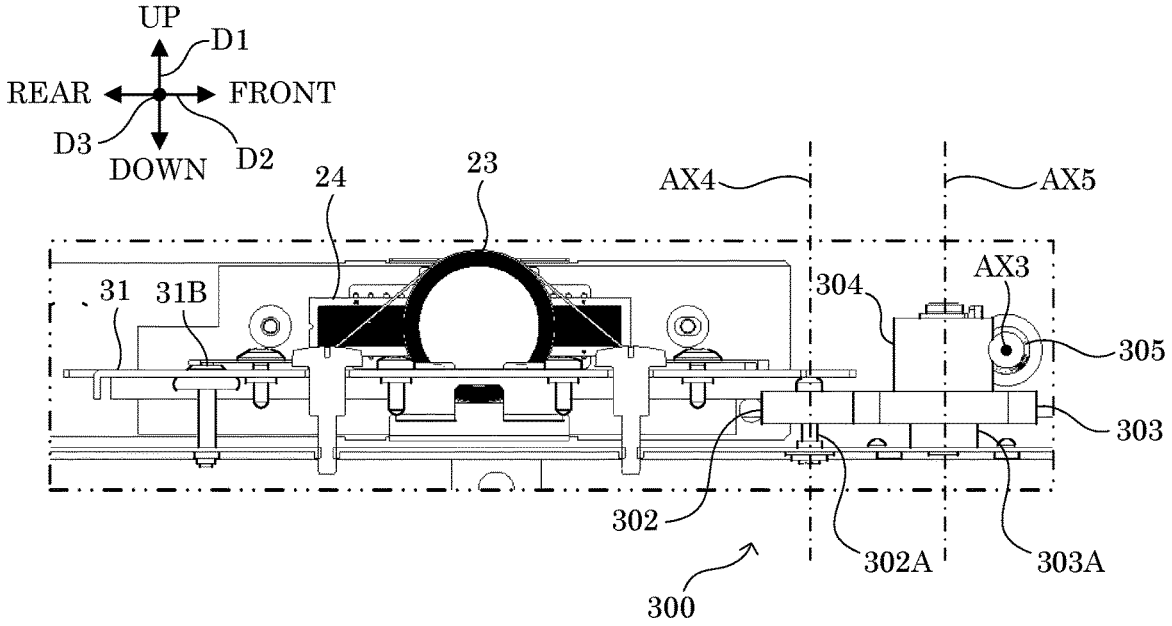
FIG. 9 is a side view showing a configuration of the posture adjustment portion of the image forming apparatus according to the third embodiment of the present disclosure.

The image forming apparatus 100 according to the third embodiment includes a posture adjustment portion 300 shown in FIG. 8 and FIG. 9 instead of the posture adjustment portion 26.

The posture adjustment portion 300 includes a support member 31, an operation portion 301, a fourth gear 302, a fifth gear 303, a sixth gear 304, and a seventh gear 305. The configuration of the support member 31 is the same as that in the posture adjustment portion 26.

The operation portion 301 is provided outside a side wall portion 25C of the housing 25. As shown in FIG. 8, the operation portion 301 is formed in a shaft shape protruding along the horizontal direction through a side wall portion 25C of the housing 25. The operation portion 301 is rotatable about the third axis AX3 (see FIG. 9) that extends along the protruding direction. The posture adjustment portion 300 adjusts the posture of the CCD 24 in accordance with the rotation of the operation portion 301.

The fourth gear 302 is provided on the lower side of the support member 31 so as to be rotatable about the fourth axis AX4 (see FIG. 9) that extends along the vertical direction (up-down direction D1). The fourth gear 302 supports the support member 31. The fourth gear 302 is displaced in the up-down direction D1 in accordance with the rotation. The fourth gear 302 is a spur gear.

For example, the fourth gear 302 has a shaft hole portion with a thread groove formed on its inner peripheral portion. A support screw 302A which protrudes upward from the lower side of the bottom portion 25B of the housing 25 toward the inside of the housing 25 is inserted into the fourth gear 302. A threaded groove in a shape corresponding to the thread groove of the inner peripheral portion of the fourth gear 302 is formed on the outer peripheral portion of the support screw 302A. The fourth gear 302 is supported by the thread groove formed on the outer peripheral portion of the support screw 302A so as to be displaceable in the up-down direction D1 in accordance with the rotation.

The fifth gear 303 is provided so as to be rotatable about the fifth axis AX5 (see FIG. 9) that is parallel to the fourth axis AX4. The fifth gear 303 meshes with the fourth gear 302. The fifth gear 303 is a spur gear.

For example, the fifth gear 303 includes a cylindrical shaft hole portion 303A (see FIG. 9) which a rotary shaft standing on the bottom portion 25B of the housing 25 is inserted into.

The sixth gear 304 is provided so as to be rotatable together with the fifth gear 303. Namely, the sixth gear 304 is provided so as to be rotatable about the fifth axis AX5 (see FIG. 9). The sixth gear 304 is a worm wheel. The sixth gear 304 is provided on the upper side of the fifth gear 303.

The seventh gear 305 is provided so as to be rotatable together with the operation portion 301. Namely, the seventh gear 305 is provided so as to be rotatable about the third axis AX3. The seventh gear 305 meshes with the sixth gear 304. The seventh gear 305 is a worm, and constitutes a worm gear together with the sixth gear 304. The seventh gear 305 is provided at a leftward tip of the operation portion 301.

In the posture adjustment portion 300, the seventh gear 305, the sixth gear 304, the fifth gear 303, and the fourth gear 302 are rotated by a rotational driving force input through the operation portion 301. Thus, the fourth gear 302 is displaced in the up-down direction D1, and the posture of the support member 31 supported by the fourth gear 302, that is, the posture of the CCD 24, is adjusted. Namely, the posture of the CCD 24 can be adjusted in the same manner as done in the posture adjustment portion 26.

Here, in the posture adjustment portion 300, the operation portion 301 is provided outside a side wall portion 25C of the housing 25. Thus, the operability of the operation portion 301 can be further improved in comparison with a configuration in which the operation portion is provided on the lower side of the bottom portion 25B of the housing 25.

It is noted that the posture adjustment portion 300 may include the second gear 32 and the third gear 35 instead of the fourth gear 302. In addition, the posture adjustment portion 300 may include an operation portion movable along a side wall portion 25C, instead of the operation portion 301. For example, it is conceivable to provide a bar-shaped operation portion extending in the left-right direction D3 so as to be movable along the front-rear direction D2 and provide an inclined surface that is inclined in the up-down direction along the moving direction of the operation portion, at a portion of the bottom surface of the support member 31 that comes in contact with the operation portion.

Meanwhile, when the operation portion used for the posture adjustment of the CCD 24 is formed in a rotatable shaft shape, it may be difficult for the operator of the operation portion to ascertain the posture adjustment amount of the CCD 24, and therefore difficult to make a fine adjustment.

In contrast, an image forming apparatus 100 according to a fourth embodiment of the present disclosure allows easy ascertainment of the posture adjustment amount of the CCD 24 as will be described below.

Fourth Embodiment

Figure 10:
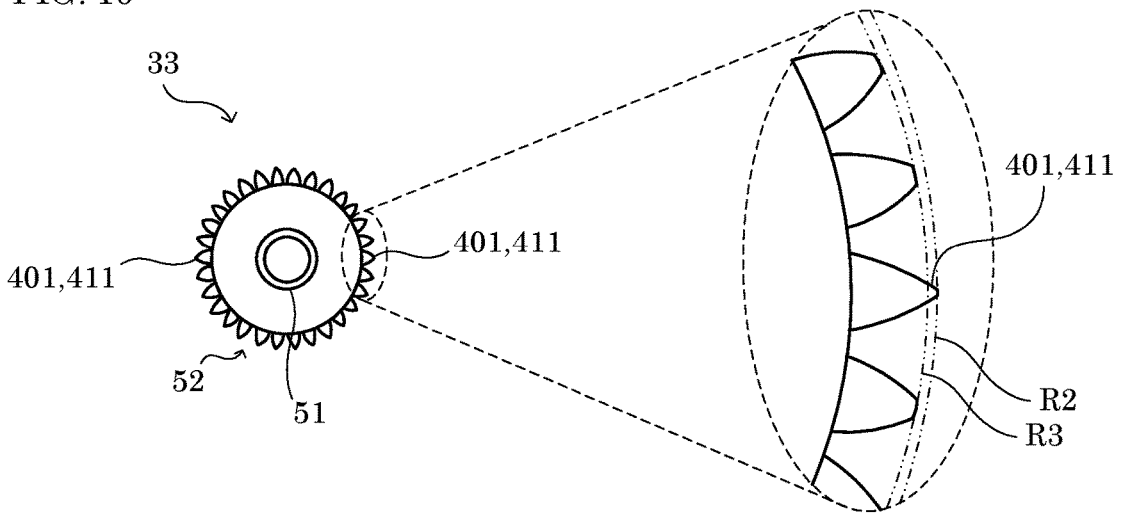
FIG. 10 is a plan view showing a configuration of a first gear of an image forming apparatus according to a fourth embodiment of the present disclosure.
Figure 11:
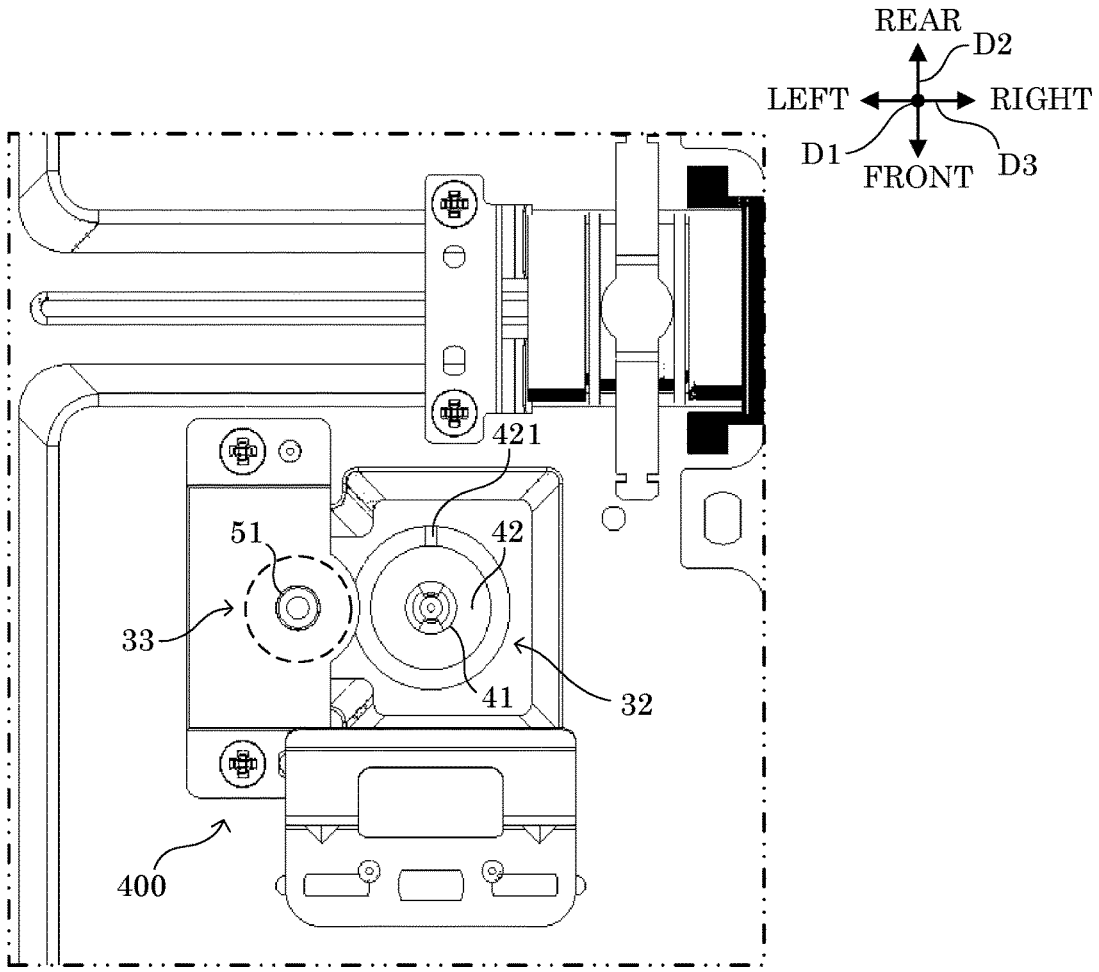
FIG. 11 is a plan view showing a configuration of a posture adjustment portion of the image forming apparatus according to the fourth embodiment of the present disclosure.

Next, a configuration of the image forming apparatus 100 according to the fourth embodiment of the present disclosure will be described with reference to FIG. 10 to FIG. 12. Here, FIG. 10 is a plan view showing a configuration of the first gear 33 provided in a posture adjustment portion 400. In addition, FIG. 11 shows a state in which the support member 31 is removed from the housing 25. It is noted that, in FIG. 10, a rotation path R2 and a rotation path R3 are indicated by dash-dot-dot-dash lines, wherein the rotation path R2 is a rotation path of a tooth tip of the tooth portion 52 at which a contact portion 411 is provided, and the rotation path R3 is a rotation path of a tooth tip of the tooth portion 52 at which the contact portion 411 is not provided. In addition, in FIG. 12, a rotation path R4 of a mark portion 421 is indicated by a broken line.

Figure 12:
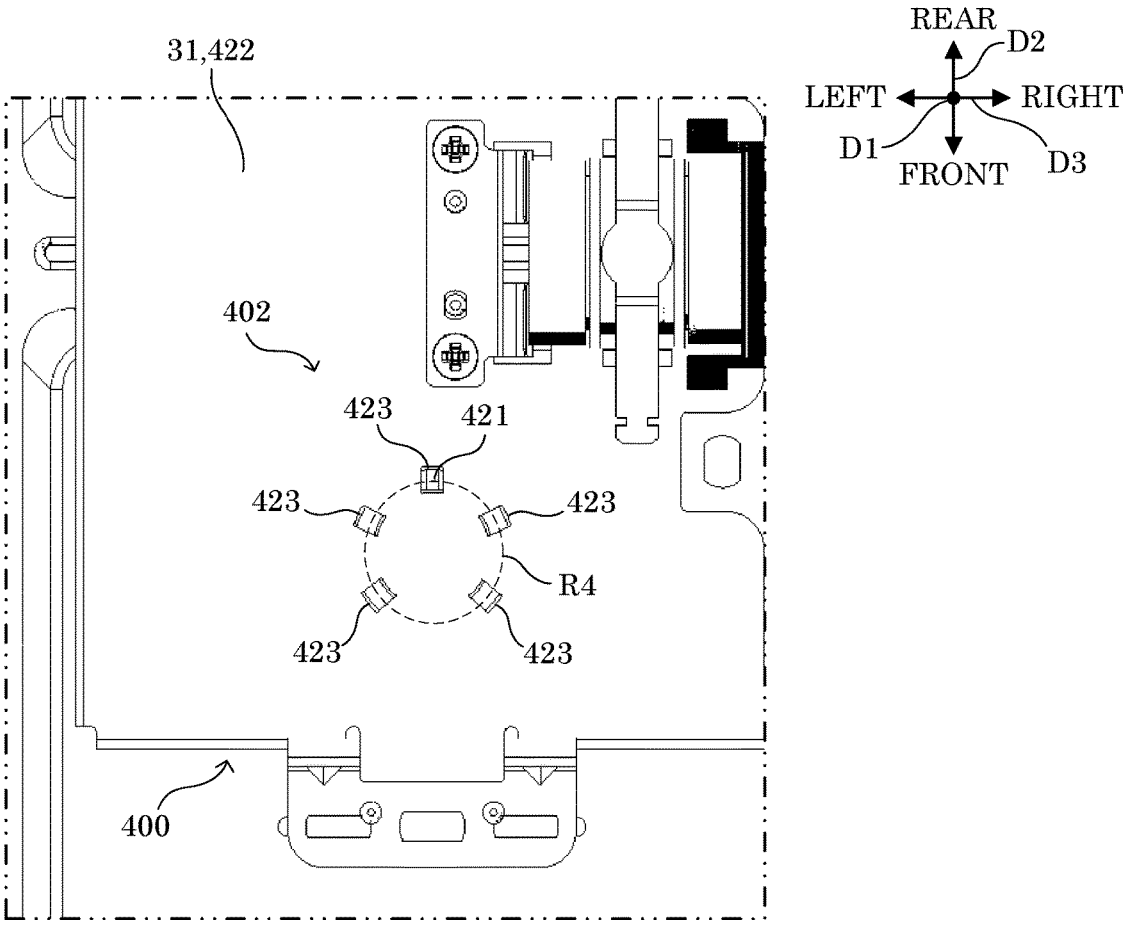
FIG. 12 is a plan view showing a configuration of the posture adjustment portion of the image forming apparatus according to the fourth embodiment of the present disclosure.

The image forming apparatus 100 according to the fourth embodiment includes a posture adjustment portion 400 shown in FIG. 11 and FIG. 12 instead of the posture adjustment portion 26.

The posture adjustment portion 400 includes a support member 31, a second gear 32, a first gear 33, an operation portion 34, and a third gear 35. The configurations of the operation portion 34 and the third gear 35 are the same as those in the posture adjustment portion 26.

In addition, the posture adjustment portion 400 includes a first stimulus output portion 401 and a second stimulus output portion 402.

Each time the operation portion 34 is rotated by a predetermined specific angle, the first stimulus output portion 401 and the second stimulus output portion 402 each output a stimulus that allows the operator of the operation portion 34 to perceive that fact. For example, the specific angle is 180 degrees.

Specifically, the first stimulus output portion 401 includes contact portions 411 provided at intervals corresponding to the specific angle in the tooth portion 52 of the first gear 33 and formed at tooth tips of the first gear 33 so as to be able to come into contact with tooth bottoms of the second gear 32.

As shown in FIG. 10, in the tooth portion 52 of the first gear 33, the tooth tip circle diameter of the tooth tip at which the contact portion 411 is provided is longer than the tooth tip circle diameter of the tooth tip at which the contact portion 411 is not provided. Thus, the tooth tip with the contact portion 411 can come into contact with a tooth bottom of the second gear 32. When the contact portion 411 comes into contact with a tooth bottom of the second gear 32, stimulus energy generated at the time of contact is transmitted to the operator of the operation portion 34 via the operation portion 34. Thus, the operator can tactilely perceive that the operation portion 34 has been rotated by the specific angle.

In addition, the second stimulus output portion 402 has a mark portion 421 and slits 423.

The mark portion 421 is formed so as to be spaced apart from the second axis AX2 on an upper side surface portion of the second gear 32 along a plane orthogonal to the second axis AX2. For example, as shown in FIG. 11, the mark portion 421 is a protrusion formed on an edge portion of the upper side surface portion of the second gear 32. It is noted that the mark portion 421 may have any configuration as long as it is visually distinguishable from the other portion by the shape, color, pattern, or the like.

The slits 423 are formed on the support member 31 which functions as a cover portion 422 (see FIG. 11 and FIG. 12) that covers the upper side surface portion of the second gear 32. As shown in FIG. 12, the slits 423 are formed at specific intervals corresponding to the specific angle along the rotation path R4 (see FIG. 12) of the mark portion 421. The slits 423 expose the mark portion 421 to the outside of the cover portion 422.

Specifically, the specific interval is a rotation amount of the second gear 32 corresponding to the rotation of the specific angle of the first gear 33. For example, in the image forming apparatus 100, when the first gear 33 rotates 180 degrees, which is the specific angle, the second gear 32 rotates 72 degrees. In this case, the specific interval is 72 degrees. Consequently, five slits 423 are formed at intervals of 72 degrees along the rotation path R4. Thus, each time the first gear 33 is rotated by the specific angle, the mark portion 421 is exposed to the outside of the cover portion 422 through a slit 423. Namely, a visual stimulus is output. Therefore, the operator of the operation portion 34 can visually perceive via the contact glass 13 that the operation portion 34 has been rotated by the specific angle.

Here, in the image forming apparatus 100 according to the fourth embodiment, the mark portion 421 and the slits 423 are provided in a positional relationship where the mark portion 421 is exposed to the outside of the cover portion 422 via a slit 423 at the timing when stimulus energy is output by a contact portion 411. Thus, the operator of the operation portion 34 can perceive both tactilely and visually that the operation portion 34 has been rotated by the specific angle. It is noted that the mark portion 421 and the slits 423 may not be provided in the above-described positional relationship.

As described above, in the image forming apparatus 100 according to the fourth embodiment, each time the operation portion 34 is rotated by the specific angle, a stimulus that allows the operator of the operation portion 34 to perceive that fact is output. Thus, the operator of the operation portion 34 can easily ascertain the posture adjustment amount of the CCD 24.

It is noted that the contact portions 411 may be provided at intervals corresponding to the specific angle in the tooth portion 52 of the first gear 33 and formed at the tooth bottoms of the first gear 33 so as to be able to come into contact with the tooth tips of the second gear 32. Specifically, the tooth bottom with the contact portion 411 of the tooth portion 52 of the first gear 33 may have any configuration as long as it is formed to have a longer tooth bottom circle diameter than the tooth bottom without the contact portion 411.

In addition, the contact portion 411 may be provided in the tooth portion 43 of the second gear 32. In addition, the contact portion 411 may be provided in both the first gear 33 and the second gear 32. In addition, the contact portion 411 may be provided in the tooth portion 52 of the third gear 35.

In addition, the mark portion 421 may be provided on a side surface portion of the first gear 33.

In addition, the image forming apparatus 100 according to the fourth embodiment may include either the first stimulus output portion 401 or the second stimulus output portion 402.

In addition, the image forming apparatus 100 according to the fourth embodiment may include, instead of the posture adjustment portion 400, a posture adjustment portion which has an operation shaft rotatable about an axis along one direction and adjusts the posture of any optical element of the light emitting portion 21A, the first mirror 21B, the second mirror 22A, and the third mirror 22B in accordance with the rotation of the operation shaft. In this case, the first stimulus output portion 401 and the second stimulus output portion 402 may be provided in that posture adjustment portion.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a photoelectric conversion portion which receives light reflected by a document sheet placed on a document sheet mounting surface and outputs an electric signal based on the light;

a housing which has a box shape with an open top and forms a housing space for housing the photoelectric conversion portion on a lower side of the document sheet mounting surface;

a housing support portion which supports a bottom portion of the housing; and a posture adjustment portion which includes an operation portion provided outside the housing and adjusts a posture of the photoelectric conversion portion in accordance with an operation on the operation portion, wherein the housing support portion forms a sheet discharge space on a lower side of the housing so as to be opened in at least one direction along a horizontal direction, the operation portion is provided on a lower side of the bottom portion of the housing, the operation portion is formed in a shaft shape protruding downward through the bottom portion of the housing, and is rotatable about an axis that extends along a protruding direction, and the posture adjustment portion adjusts the posture of the photoelectric conversion portion in accordance with a rotation of the operation portion.

2. The image forming apparatus according to claim 1, wherein when the axis is a first axis, the posture adjustment portion includes:

a support member which supports the photoelectric conversion portion on a lower side of the photoelectric conversion portion;

a second gear which is provided on a lower side of the support member so as to be rotatable about a second axis that is parallel to the first axis, supports the support member, and is displaced in an up-down direction in accordance with a rotation; and a first gear which is provided so as to be rotatable together with the operation portion and meshes with the second gear.

3. The image forming apparatus according to claim 2, wherein the posture adjustment portion includes:

a third gear which is provided on a lower side of the second gear so as to be rotatable about the second axis, meshes with the first gear, and is provided with a cam surface which undulates up and down along a circumferential direction of the second axis at a portion facing the second gear, and the second gear is provided with a pressed portion pressed by the cam surface at a portion facing the third gear, and includes a different number of teeth from the third gear.

4. The image forming apparatus according to claim 1, wherein when the axis is a first axis, the posture adjustment portion includes:

a support member which supports the photoelectric conversion portion on a lower side of the photoelectric conversion portion;

a second gear which is provided so as to be rotatable about a second axis that is parallel to the first axis on a lower side of the support member, supports the support member, and is displaced in an up-down direction in accordance with a rotation;

a first gear provided so as to be rotatable together with the operation portion and spaced apart from the second gear in a direction orthogonal to the second axis; and a belt member which is wound around the first gear and the second gear and transmits, to the second gear, a rotational driving force input to the first gear.

5. An image forming apparatus, comprising:

a photoelectric conversion portion which receives light reflected by a document sheet placed on a document sheet mounting surface and outputs an electric signal based on the light;

a housing which has a box shape with an open top and forms a housing space for housing the photoelectric conversion portion on a lower side of the document sheet mounting surface;

a housing support portion which supports a bottom portion of the housing; and a posture adjustment portion which includes an operation portion provided outside the housing and adjusts a posture of the photoelectric conversion portion in accordance with an operation on the operation portion, wherein the operation portion is provided outside a side wall portion of the housing, the operation portion is formed in a shaft shape protruding along a horizontal direction through the side wall portion of the housing, and is rotatable about an axis that extends along a protruding direction, and the posture adjustment portion adjusts the posture of the photoelectric conversion portion in accordance with a rotation of the operation portion.

6. The image forming apparatus according to claim 5, wherein when the axis is a first axis, the posture adjustment portion includes:

a support member which supports the photoelectric conversion portion on a lower side of the photoelectric conversion portion;

a first gear which is provided on a lower side of the support member so as to be rotatable about a second axis along a vertical direction, supports the support member, and is displaced in an up-down direction in accordance with a rotation;

a second gear which is provided so as to be rotatable about a third axis that is parallel to the second axis and meshes with the first gear;

a third gear provided so as to be rotatable together with the second gear; and a fourth gear which is provided so as to be rotatable together with the operation portion and meshes with the third gear.

* * * * *